United States Patent [19]

Dietzel et al.

[11] 4,063,959

[45] Dec. 20, 1977

[54] CONTINUOUSLY OPERATING SUGAR CENTRIFUGE

[75] Inventors: Walter Dietzel; Siegfried Matusch; Volkmar Hentschel, all of Braunschweig, Germany

[73] Assignee: Braunschweigische Maschinenbauanstalt, Braunschweig, Germany

[21] Appl. No.: 715,615

[22] Filed: Aug. 18, 1976

[30] Foreign Application Priority Data

Mar. 4, 1976 Germany ..... 2608911

[51] Int. Cl.[2] ..... C13F 1/06; C13F 1/10

[52] U.S. Cl. ..... 127/19; 210/369

[58] Field of Search ..... 127/19, 56; 210/369

[56] References Cited

U.S. PATENT DOCUMENTS

| | | | |
|---|---|---|---|
| 2,096,594 | 10/1937 | Sanchez | 127/19 UX |
| 2,973,288 | 2/1961 | Riedel | 127/19 |
| 3,250,391 | 5/1966 | Pause | 210/369 |
| 3,327,401 | 6/1967 | Stamos | 210/369 X |
| 3,490,947 | 1/1970 | Grieselhuber | 127/19 |
| 3,496,016 | 2/1970 | Siepe | 127/19 |
| 3,799,353 | 3/1974 | Pause | 210/369 |
| 3,837,913 | 9/1974 | Hillebrand | 127/19 |
| 3,989,536 | 11/1976 | Werner | 127/19 |
| 4,000,074 | 12/1976 | Evans | 210/369 |
| 4,008,098 | 2/1977 | Dietzel | 127/19 |

*Primary Examiner*—Sidney Marantz

*Attorney, Agent, or Firm*—Wolfgang G. Fasse; Willard W. Roberts

[57] ABSTRACT

A continuously operating centrifuge for producing a high purity sugar or sugar syrup, has an acceleration bell or cone which acts as a preliminary separator, and a centrifugal basket, the lower portion of which acts as a washing stage. A damming ring is spaced from the upper edge of the basket to form with said upper edge a sugar exit gap. A discharge ring is arranged to cooperate with the damming ring. The discharge ring rotates with the basket, but about an axis extending at an angle relative to the rotational axis of the basket, whereby the actual sugar exit is confined to a predetermined zone along said sugar exit gap. A flow channel cooperates with said zone to receive the sugar without damage to the sugar crystals.

13 Claims, 9 Drawing Figures

CONTINUOUSLY OPERATING SUGAR CENTRIFUGE

BACKGROUND OF THE INVENTION

The present invention relates to a continuously operating centrifuge especially one suitable for a medium quality product and/or for so-called white sugar massecuite. Such centrifuges have conventionally a centrifugal basket which rotates about a vertical axis. The basket has a conical shape, the larger diameter end of which faces upwardly. The centrifugal basket is provided with a screen on the inside of the basket. The basket is secured to the upper free end of a drive shaft. A distribution cup is also secured to said upper end of the drive shaft to reach into the centrifugal basket. Distribution pins are located inside the distribution cup slightly spaced from the wall of the distribution cup. An acceleration cone or bell extends from the distribution cup to the bottom of the centrifugal basket. The acceleration cone faces downwardly with its larger diameter end. Further, a filling device through which massecuite is supplied into the distribution cup, is part of the centrifuge.

Numerous attempts have been made to develope an operational, continuously working centrifuge, capable of handling a product of average quality or so-called white sugar massecuite in an economic manner and simultaneously with sufficient quality. To achieve such a goal it is necessary to overcome two substantial difficulties. One problem resides in the fact that a product produced in a continuously operating centrifuge does not have the desired purity because the so-called washing or purging is insufficient in a continuously operating centrifuge to remove syrup remainders to the extent necessary for producing white sugar. The other problem resides in the fact that in a continuously operating sugar centrifuge, the sugar crystals are subjected to mechanical wear in an undesirable extent. A portion of the mechanical wear is caused by the sliding movement of the sugar crystals inside the centrifuge. However, a substantially serious damage to the sugar crystal results because the sugar crystals bounce against a fixed wall after passing a relatively short pass when they are ejected at the upper end of the centrifugal basket, especially since the ejection speed corresponds to the circumferential speed of the upper edge of the basket.

Heretofore, those skilled in the art have been of the opinion that it was merely necessary to keep the sugar in a sufficiently thick layer for an appropriate length of time in the centrifugal basket of a continuously operating centrifuge in order to perform the washing operation in such a manner that the quality of the product corresponds to that produced in batch type centrifuges.

Thus, U.S. Pat. No. 3,799,353 and German Patent Publications Nos. 21, 51, 476 as well as 21, 51, 475 disclose a continuously operating centrifuge of the so-called thick layer flow type constructed to produce white sugar from a respective white sugar massecuite.

In such a centrifuge the massecuite is supplied through a vertical filling pipe into a conical acceleration device opening downwardly. This acceleration device is constructed as an accumulation bell which may be lifted and lowered. This feature is intended to accelerate the supplied massecuite to the circumferential speed even prior to the time the massecuite reaches the centrifugal basket. The centrifugal basket comprises a screen and its slope varies in stages, the upper edge of the basket is provided with a so-called accumulation ring which defines together with the upper edge of the basket, a passage gap for the sugar. A dosing slide is arranged radially outside of the passage gap for the sugar. The slide has a downwardly slanting collar forming a ring. The ring collar is rigidly secured by means of bolts to the centrifugal basket and spring biassed to keep the ring collar in a starting position in which its downwardly directed portion blocks the flowing movement of the sugar through the sugar discharge gap. A magnet held in a fixed position is arranged to lift the dosing slide relative to the centrifugal basket when the latter is in a predetermined rotational position so that in this position the sugar discharge may take place. The stroke of the dosing slide is controllable by the adjustment of the energizing of the magnet.

The just described elements of the prior art are intended to produce on the screen of the centrifugal basket a very thick sugar layer by the respective accumulation resulting from the control of the dosing slide. Such a thick layer is supposed to be chargable with washing water in the same manner as is possible in a batch type centrifuge operating with a thick sugar layer. In addition, the just described prior art elements are intended to provide a relatively longer residence time of the sugar within the centrifuge.

Disregarding for the moment that thick layers of material may cause critical and even dangerous operational conditions especially where the massecuite may have an inhomogeneous structure due to locally different flow characteristics, simple considerations will show that it is not possible to produce white sugar of a sufficient quality by employing the thick layer principle alone. For example, the quantity of the liquid component of the massecuite becomes the larger, the thicker the layer of the material on the screen of the centrifugal basket. This means in turn, that a material layer of a certain thickness requires a corresponding length of time for the removal of the liquid component from the material. The washing water also requires in the same sense more time for penetrating a thick layer. The washing water must also be removed as so-called high green syrup. The flow path of the massecuite is much too short in the known thick layer flow centrifuge to provide for the required lengths of time. Thus, in order to produce white sugar of the corresponding or sufficient quality, it would be necessary that the dosing slide blocks the sugar exit until sugar of suitable quality results from the washing. For the same lengths of time, the control means would have to interrupt the supply of further massecuite. Only after sugar of the desired quality has been produced would it be possible to open the dosing slide, to discharge the sugar and to replace the layer of material in the centrifuge by an inflow of massecuite. However, as soon as the massecuite reaches the upper area adjacent to the edge of the centrifugal basket, the dosing slide would have to be closed instantaneously to make it possible to process the material in the centrifuge until the desired quality is obtained. This type of operation is thus only suitable as a theoretical possibility and it is not possible to realize an economic production sequence because the through-put per unit of time is much too small. Furthermore, the above mentioned publications do not disclose any teaching how the sugar quality could be monitored.

Further substantial drawbacks in the practical construction of the known centrifuge are seen in that the electromagnet is not capable to timely operate the dosing slides against the spring forces and against the prevailing mass forces. Moreover, it is quite likely that a non-symmetry in the loading of the centrifuge will result when the dosing slide is lifted against the force of the springs which tend to hold it down. This may result in an uneven rotation and possibly heavy vibrations of the centrifuge. Thus, the prior art also suggests to lift and lower the dosing slide by air pressure or by mechanical means. However, such solutions are technically unsound.

German Pat. No. 12, 72, 229 also addresses itself to realizing a continuously operating white sugar centrifuge. In this German Patent it is suggested to use an acceleration cone which is provided at its lower, wide end with only a small passage gap for the material to be centrifuged. This gap faces in the axial direction against a screen. By these means it is intended to achieve a sedimentation in the acceleration cone of the material to be centrifuged. By these means it is intended to cause the sugar crystals to accumulate on the wall of the acceleration cone while the liquid phase is supposed to be separated radially inwardly, that is, on the crystal layer so that it may flow off through the screen. In this manner, it is supposed to be possible to operate the centrifugal basket with a lower rpm, whereby to reduce break-up or damage to the sugar crystals. However, this prior art teaching cannot be realized in practice, because the desired sedimentation does not take place to the extent necessary for the removal of a substantial proportion of the liquid quantity.

Even if one assumes the desired degree of sedimentation may be accomplished, this would still be of substantial disadvantage to the quality of the sugar because the sugar crystals would be subjected to a dry sliding movement on the surface of the acceleration cone. In addition, the crystals would be subjected to an increased gravity action and slide relative to each other. As a result, crystal destruction and crystal rub-off could not be avoided and sugar of the desired quality could not be produced. Besides, if the known centrifuge is supposed to operate with rpms lower than normal, the intended sedimentation becomes still more unlikely. In the known centrifuge, the massecuite is supplied off center into the acceleration cone, whereby radially extending wings accelerate the massecuite. These wings beat the massecuite and cause damage to a substantial proportion of the crystals due to the instantaneous acceleration. Thus, a uniform, careful distribution of the massecuite over the surface of the cone and a respectively gentle acceleration are impossible in the known apparatus. Hence, known centrifuges are not suitable for centrifuging of white sugar massecuite, nor can they be used for this type of work with high efficiency and large through-put capacities due to said unsatisfactory accelerations.

OBJECTS OF THE INVENTION

In view of the above it is the aim of the invention to achieve the following objects singly or in combination:

- to construct a continuously operating centrifuge in such a manner that it is capable to process white sugar massecuite or medium quality massecuite for producing sugar of the desired quality in an economical manner;
- to produce liquid sugar syrup or white sugar with the desired purity in a continuously operating centrifuge;
- to treat the sugar crystals gently to thereby avoid mechanical damage to the sugar crystals;
- to assure a central filling of the massecuite into the centrifuge so that local differences in the flow characteristics may not cause undesirable vibrations;
- to make sure that the sugar crystals are not exposed to a dry sliding movement and undue rubbing relative to each other; and
- to avoid the bouncing of the sugar crystals against fixed walls of the housing.

SUMMARY OF THE INVENTION

According to the invention there is provided a continuously operating sugar centrifuge in which the acceleration cone or bell is constructed as a pre-separation stage which includes means for the flow-off of the liquid component of the massecuite. The lower portion of the centrifugal basket is constructed as a washing stage. A damming ring is arranged with a spacing relative to the upper edge of the centrifugal basket, said spacing extending in the axial direction. The damming ring forms together with the upper edge of the basket a sugar exit gap. A discharge ring is arranged opposite said gap with a radial spacing between the discharge ring and the gap. The discharge ring has a downwardly sloping collar and rotates in synchronism with the centrifugal basket about a slanted rotational axis. Whereby the discharge ring collar confines the sugar exit to a predetermined zone along the basket circumference. A flow channel is arranged to receive the sugar crystals through this limited discharge zone without destroying or even damaging the sugar crystals.

The centrifuge, according to the invention, comprises certain functional zones. The filling or charging device, that is, the acceleration cup and the distribution pins are capable of uniformly distributing the massecuite over the surface of the cup wall in the shortest possible time, even if very large throughput quantities are to be handled, whereby simultaneously the cup accelerates the massecuite to the circumferential speed. The just described feature has the advantage that the following acceleration bell or cone may be employed as a preliminary separation stage during the processing of medium quality products or white sugar massecuite in order to separate the liquid components of the massecuite. The acceleration cone which follows the distribution cup also serves the function to further the uniform distribution of the massecuite layer and to accelerate it where less flowable massecuite is used, especially the so-called low grade massecuite. In order to use the acceleration cone as a preliminary separation stage, as taught by the invention, there is provided a screen layer as well as flow-off means for the liquid component of the massecuite from the acceleration cone.

Contrary to prior art centrifuges which are constructed for processing medium quality products, and white sugar massecuite, the centrifuge according to the invention is capable of providing at the bottom of the centrifugal basket, a product which is substantially free and possibly completely free of the liquid component. Such a product thus enters the centrifugal basket, rather than being produced in the centrifugal basket.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS

Figure 1:
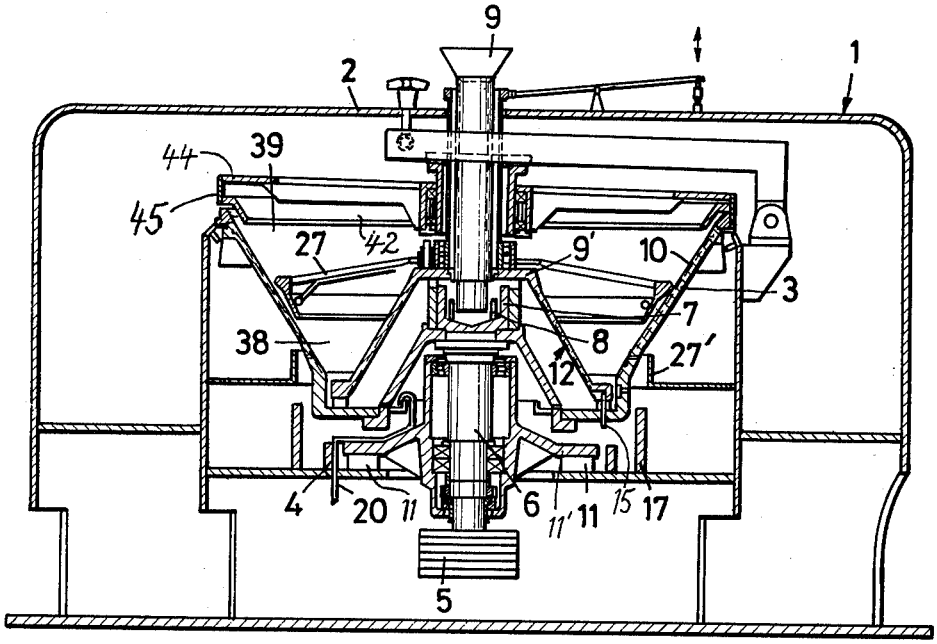
FIG. 1 shows a sectional view through one embodiment of a centrifuge according to the invention.

FIG. 1 illustrates a continuously operating centrifuge 1, having a housing 2 in which the centrifugal basket 3 is supported on a vertical rotational shaft or axis 6. The drive shaft 6 itself is supported in a conventional bearings secured to a base plate 4. The lower end of the drive shaft 6 carries a pulley 5 operatively connected to a drive motor not shown.

An acceleration and distributor cup 7 is secured to the upper free end of the drive shaft 6. The centrifugal basket 3 in turn is secured to the cup 7 by conventional means. A plurality of distributor pins 8 are arranged in the cup 7. These pins are secured to the bottom of the cup and extend in parallel to the rotational axis and slightly spaced relative to the inner walls of the cup 7. The massecuite is supplied into the cup 7 by means of a feeder pipe 9 the lower end of which reaches to a level close to the bottom of the cup 7 or at least to a level which is lower than the upper end of the distributor pins 8.

The acceleration cone or bell 9′ is secured to the distributor cup 7 and has the shape of a frustum, the large diameter end of which opens downwardly. The centrifugal basket 3 has the shape of a cone opening upwardly. Inside the cone a separation screen 10 rests on the centrifugal basket. As mentioned, the drive shaft 6 and with it the elements secured thereto, namely, the centrifugal basket 3, the acceleration cone 9′, the acceleration and distributor cup 7 are secured on the base plate 4 in the housing 2, whereby vibration damping elastic elements 11 are located between a bearing housing 11′ and the base plate 4.

In the light of the above stated object to construct a continuously operating centrifuge so that it is capable of producing white sugar efficiently and with a substantial throughput capacity, the acceleration cone 9′ is provided with a screen 12 on the inner surface thereof. The screen 12 rests on a suitable support webbing 13, thereby creating liquid flow passages behind the screen 12.

The just described arrangement according to the invention, achieves a very effective uniform distribution and acceleration of the massecuite in the acceleration cup 7, by means of the distributing pins 8, whereby it is possible to utilize the acceleration bell 9′ as a preliminary separation stage in which the liquid phase of the massecuite is substantially removed. This is not possible in prior art devices because there the acceleration cone is required for acceleration and distribution purposes. The liquid phase of the massecuite which is also known as so-called green run-off travels or flows through the passages provided by the supporting webbing 13 toward the larger diameter end of the acceleration bell 9′ where it is collected in channels 14 for removal from the drum at the lower end of the acceleration bell 9′ through one or several pipes 15 extending through the bottom 16 of the centrifugal basket 3.

A separation wall 17 is arranged inside the housing 2 to prevent the mixing of the green run-off with any other run-off. This separation wall 17 provides a collection space for the green run-off, also known as initial run-off.

In connection with this preliminary separation in the acceleration bell 9′, it is essential that no sedimentation of crystals and liquid occurs. Rather, it must be assured that in response to the centrifugal force, a continuous liquid phase, namely the green run-off, travels radially through the layer of material to the screen 12 so that a continuous liquid film is present on the screen 12. Such liquid film acts as a friction reducing means whereby the sugar crystals are transported in a gentle manner since a dry sliding movement would result in wear of the sugar crystals as well as in the destruction of the sugar grains which is undesirable with regard to the sugar quality.

It should be mentioned at this point that the flow passages for the liquid phase inside the acceleration bell 9′ could be provided by respective grooves in the inner surface of the acceleration bell 9′. In such an embodiment it would be unnecessary to employ the support webbing 13.

Figure 5:
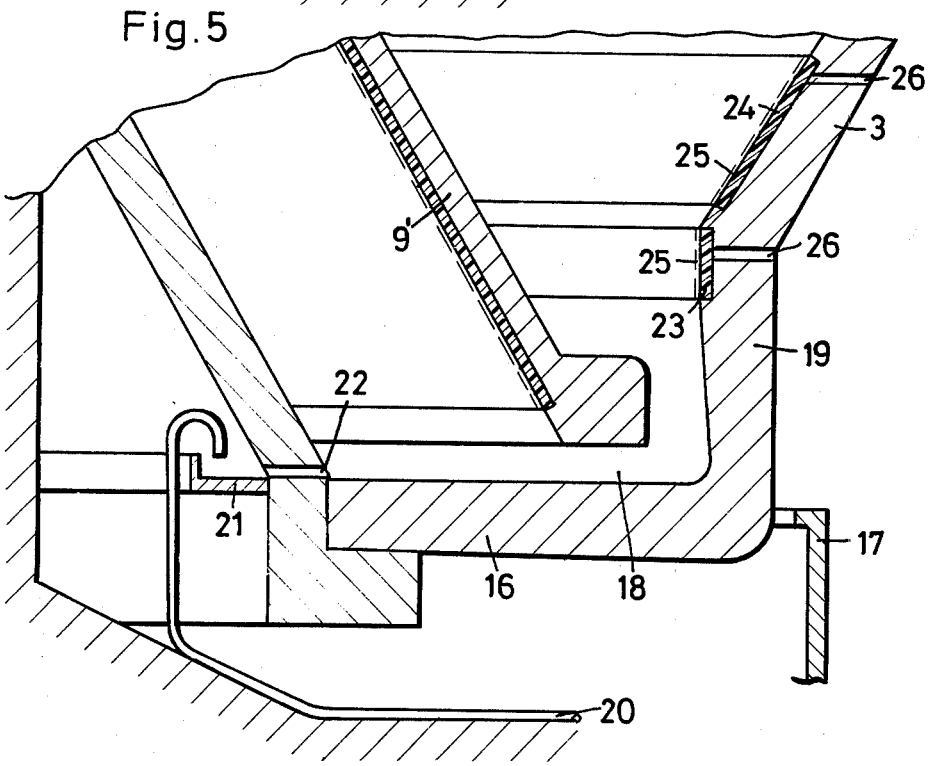
FIG. 5 illustrates a view similar to that of FIG. 4 and showing the washing liquid supply to the washing zone below the acceleration cone.

After the initial or green run-off has been substantially removed in the acceleration bell 9′ operation as a preliminary separation stage, it is essential that any syrup remainders which might be sticking to the surface of the crystals in the form of very thin skins or films, are removed or washed off. In batch type centrifuges this is accomplished by the washing process. However, a washing process as it is being practiced in batch type centrifuges having a cylindrical centrifugal drum, cannot be realized in a continuously operating centrifuge for several reasons. In order to assure the just mentioned removal of the syrup remainders, the invention provides a washing stage, as shown in FIG. 5. The washing stage is connected in series with the preliminary separation stage.

The material to be centrifuged leaves the acceleration bell 9′ at the lower edge thereof through a gap 18 defined by said lower edge of the acceleration bell 9′ and the bottom 16 of the centrifugal basket. The material flows radially outwardly into the lower area 19 of the basket 3. Normally this lower portion has a cylindrical shape and serves for the purpose to impart an after acceleration to the material to be centrifuged, because during the time when the material travels freely from the acceleration bell 9′ to the lower area 19 of the baskets 3, no further acceleration takes place. However, the lower edge of the acceleration bell 9′ has a lower circumferential speed than the lower area 19 of the basket 3.

Due to the after acceleration in the lower area 19 of the basket 3, a certain temporary slow down in the movement of the material in the flow through direction takes place also in prior art continuously operating centrifuges. The invention takes advantage of this effect by supplying washing liquid, for example, purging water into the lower area 19 of the basket 3 by means of a pipe 20. The pipe 20 receives the washing water from outside of the housing 2 in a suitable manner and supplys it into a rotating washing water ring 21 as shown in FIG. 5. The washing water shows the influence of the centrifugal force through the channels 22 below the material and along the bottom 16 of the basket 3 and from there into the lowest area 19 of the basket 3. At this point, or rather in the area 19, an intimate mixing of washing water and sugar crystals takes place since the sugar crystals must be subjected to a further acceleration. It is possible to increase the residence time, and thus the washing effect, by providing the lower area 19 of the basket 3 with a slightly outwardly flaring conical shape, as shown in FIG. 5.

The intimate mixing and the brief delay in the flow movement in the flow direction, have the effect that the washing liquid is distributed in the mass of sugar crystals, thereby having an opportunity to wet all crystal surfaces. This is advantageous since here again it is essential that dry friction is avoided. For this purpose the lower area 19 of the basket 3 is covered with screens 23, 24 which also rest on a support webbing 25 to provide discharge passages for the liquid which passes through the screens and the webbing. Discharge channels 26 are arranged in the wall of the basket 3. A further separation wall 27' inside the housing assures that the portion of the centrifuged liquid phase may be discharged separately. It is essential to make the open surface area of the screen 23 and 24 relatively small so that only a small liquid proportion may pass therethrough and to assure the necessary residence time of the washing liquid in the layer of the sugar crystal as required for the washing process. The screens 23 and 24 merely make certain that the sugar crystals may slide on a liquid film over the lower area 19 of the basket 3.

Figure 6:
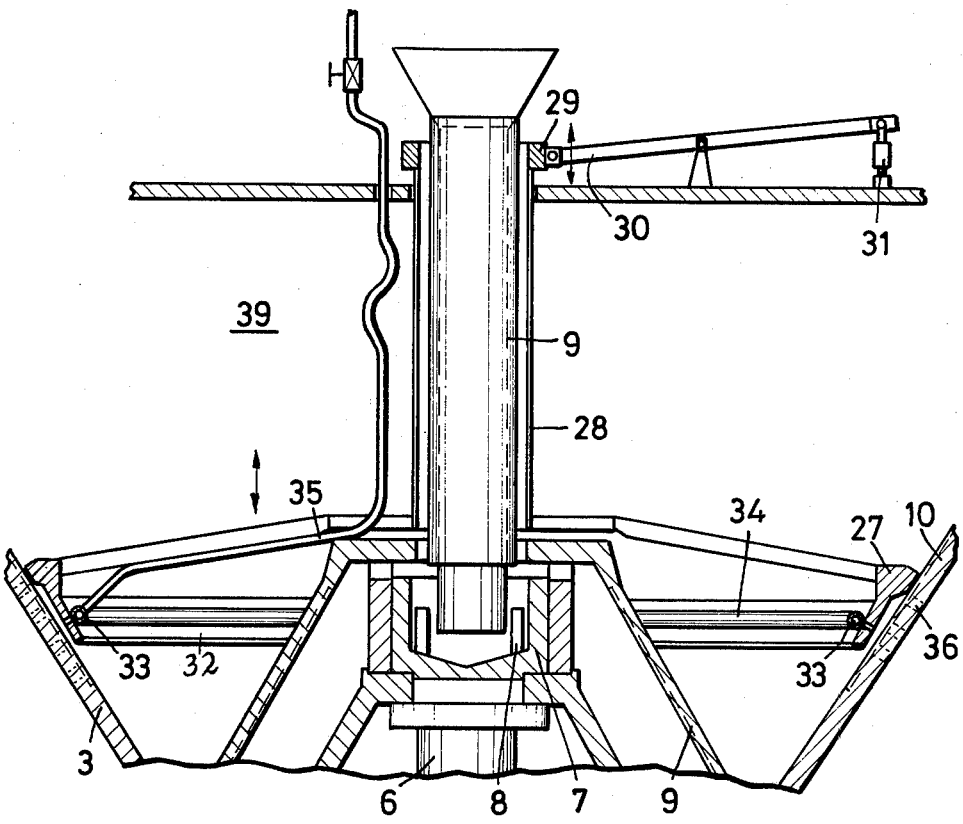
FIG. 6 illustrates the construction and arrangement of the separation plate, showing a sectional view through the lower portion of the centrifuge basket and acceleration cone as well as the distribution cup.

As the sugar crystals leave the lower area 19 of the basket 3, they come into the area of the separation screen 10 of the basket 3. The space of this area is divided by the separation plate 27, shown in detail in FIGS. 6 and 7. In the embodiment of FIG. 6 a cylinder 28 surrounds the filling pipe 9. The cylinder 28 may be lifted and lowered. For this purpose a fork 30 engages the pipe 9 at a collar 29. The fork 30 may be raised and lowered by a suitable means, either automatically or by hand, for example, by means of a threaded spindle 31. In the embodiment of FIG. 6, the separation plate 27 is in a fixed position. Stated differently, the separation plate 27 does not participate in the rotation of the basket 3. The separation plate 27 comprises a downwardly reaching collar 32, provided with a plurality of steam nozzles 33. Steam is supplied to these nozzles 33 through a steam pipe 34, which may be arranged inside the separation plate 27. A flexible hose or the like 35 is connected to the steam pipe 34 to accomodate the up and down movements of the separation plate 27.

The layer of sugar crystals which after leaving the lower area 19, travels along the separation screen 10, may be subjected to an intensive steam treatment when it reaches the area below the collar 32 of the separation plate 27. If desired, further washing water may be supplied through the nozzles 33 rather than steam. In any event, it is assured that the medium passing through the nozzles 33 onto the layer of sugar crystals, is not transformed into a whirling or eddy flow. In addition, the ventilation effect resulting from the high rotational speed of the basket 3, does not entrain a medium flowing through the nozzles 33. As a result, the medium, whether steam or liquid, is pressed reliably through the layer of sugar crystals so that an intensive further washing or purging process takes place, whereby the sugar crystals are separated completely from any syrup remainders which might still stick to the crystal surface. In order to make this wash and purging effect as intensive as possible, it is suitable to locate the separation plate 27 in the embodiment of FIG. 6, in which the plate is stationary, as close as is possible near the surface of the crystal layer, however, without directly touching the crystal layer. Such touching would be undesirable since it may result in crystal rub-off.

The washing and purging effect in the area of the separation plate 27 may be enhanced by providing apertures 36 in the basket 3 at least in the area of the separation plate 27. Such apertures 36 enhance the vigorous material transport from the inside of the basket 3 in an outward direction.

The arrangement of the separation plate 27 shown in FIG. 6 has the advantage that the supply of washing water or steam is relatively simple, because the separation plate 27 is stationary. Yet another advantage of this embodiment is seen in that the separation plate 27 may be raised and lowered so that its position may be adapted to varying thicknesses of the sugar crystal layer, thus, the gap between the surface of the crystal layer and the separation plate 27 may be kept as small as possible, while nevertheless assuring that a contact between the plate and the crystals is avoided at all times, thus also avoiding any rubbing of the crystals against the separation plate 27.

Figure 7:
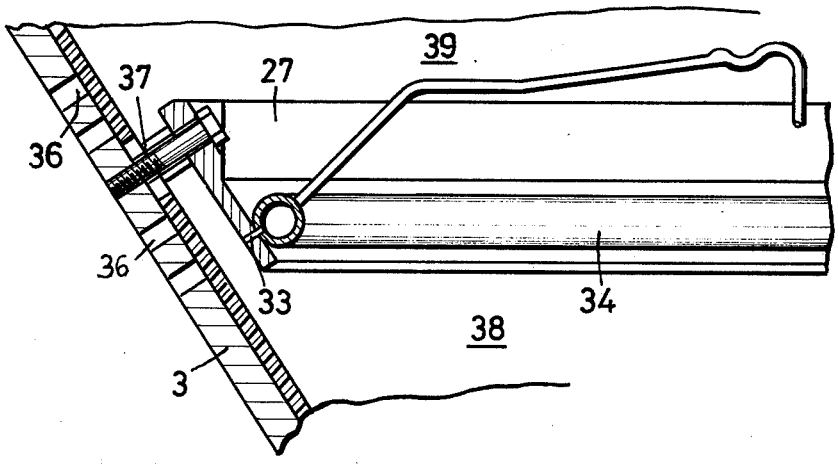
FIG. 7 is a view similar to that of FIG. 6, but illustrating a modified embodiment of the separation plate.

In the embodiment of FIG. 7 the separation plate 27 is secured to the wall of the basket 3 by means of holding bolts 37 so that the plate rotates with the basket. The separation plate 27 thus cannot be raised nor lowered. This embodiment is therefore especially suitable for use where the operation results in a sugar crystal layer having a constant thickness. In order to supply steam or washing water to the nozzles 33 in the embodiment of FIG. 7, the respective supply pipes 34 must extend centrally through the acceleration and distribution cup 7, and also through the drive shaft 6 to end up in a rotational coupling which permits the rotation of the plate 27. Such rotational couplings are well known in the art and hence not shown in FIG. 7.

The plate 27 separates the space inside the basket 3 into a lower space 38 and an upper space 39. A humid atmosphere may be formed in the lower space 38 due to the water and ventilation effect. However, the upper space 39 can be maintained dry so that the sugar layer which is already white after it passes the passage between the basket and the separation plate 27, may be pre-dryed until it reaches the upper edge 40 of the basket 3. Such pre-drying is required for a product of high quality.

As outlined above, it is important to prevent the sugar crystals as they depart from the upper edge 40 of the basket 3, from bouncing against the walls of the housing 2 in order to avoid damage to the crystals, whereby the desired quality would be lost.

Figure 2:
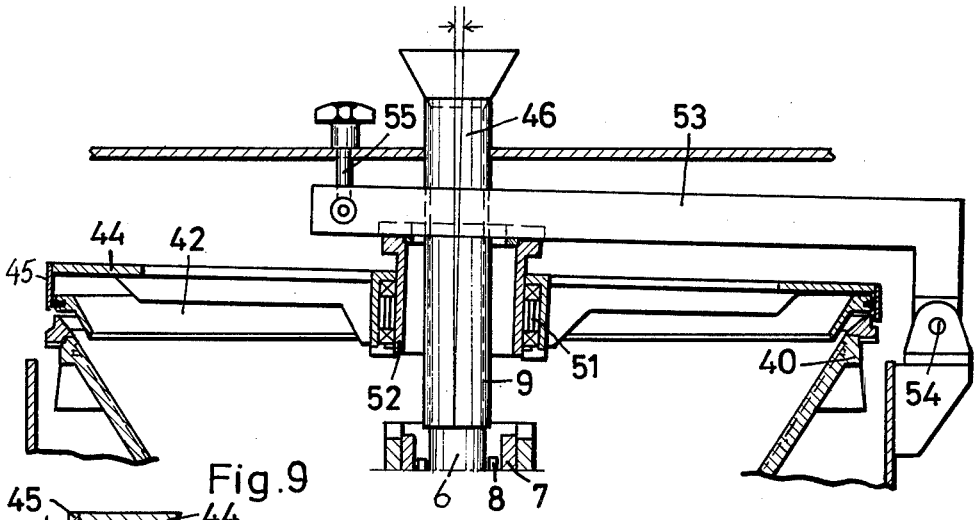
FIG. 2 illustrates on an enlarged scale, a sectional view of the upper end of the centrifuge basket or drum.
Figure 9:
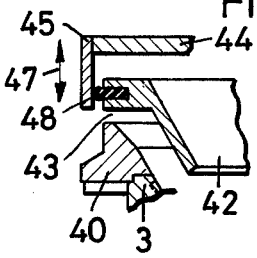
FIG. 9 shown on the same sheet as FIGS. 2 and 3, illustrates on an enlarged scale, a partial sectional view, illustrating the relationship between the upper drum or basket edge and the discharge ring.
Figure 3:
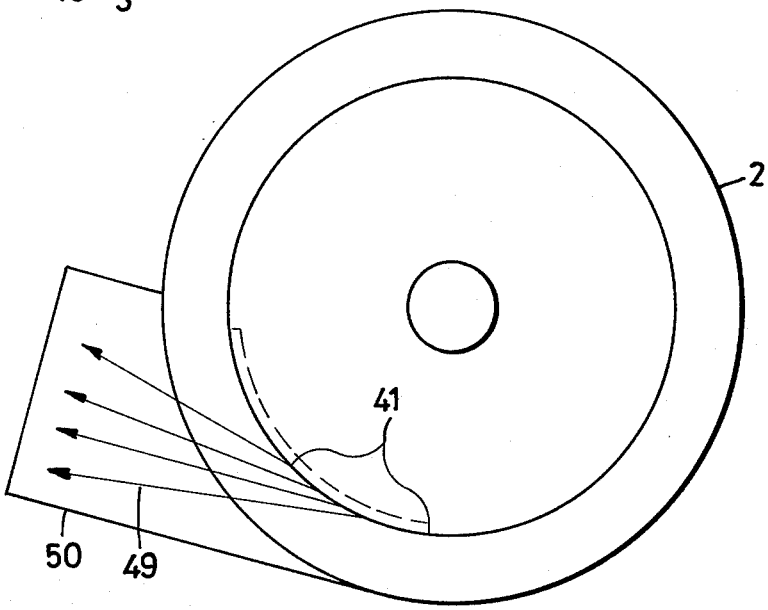
FIG. 3 is a simplified plan view into the centrifuge basket of the invention.
Figure 4:
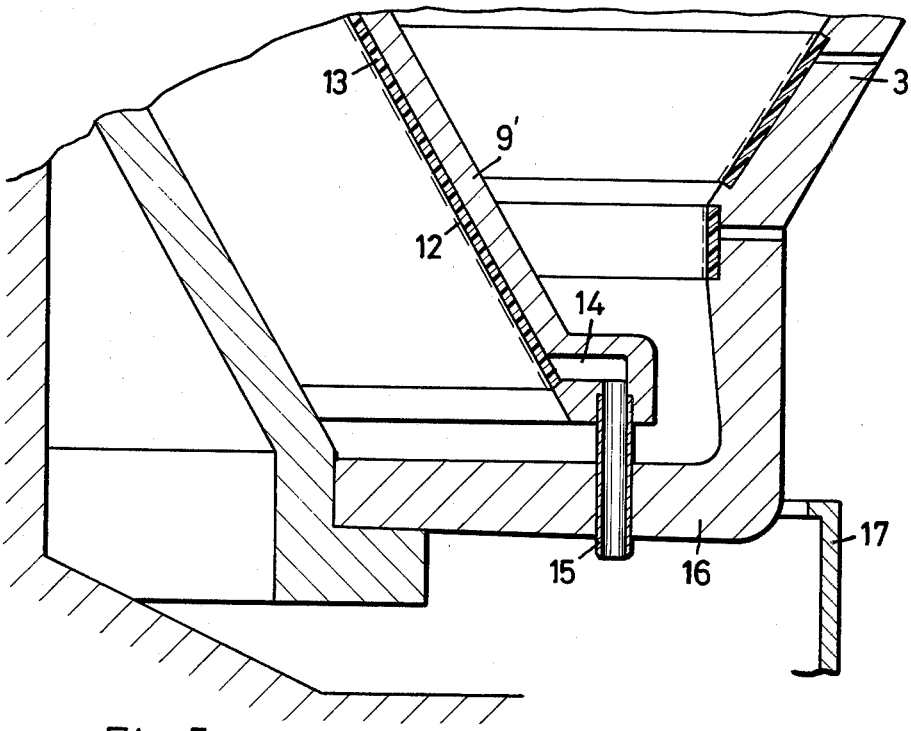
FIG. 4 illustrates on an enlarged scale a partial sectional view showing a detail of the flow-off from the acceleration bell or cone.

To this end, the sugar is discharged at a limited position 41 along the circumference of the upper edge 40 of the basket 3 as shown in FIG. 3. Moreover, care is taken that this limited position 41 is stationary in space. According to the invention, this is accomplished, please see FIG. 9, by means of a damming ring 42 arranged in a spaced relationship relative to the upper edge 40 of the basket 3. The damming ring 42 and the upper edge 40 define a sugar exit gap 43 cooperating with a discharge ring 44 having a lower collar 45 slanted downwardly. The collar 45 is located opposite the sugar exit gap 43 and slightly spaced therefrom in the radial direction. The discharge ring 44 is rotatable about a rotational axis 46 extending at an angle relative to the rotational axis of the drive shaft 6 of the basket 3. The discharge ring 44 is driven either by a drive dog secured, for example, to the basket 3 and engaging the ring 44. Such drive dogs are not shown in FIGS. 2 and 9. The ring 44 may also be rotated by frictional engagement with the sugar. The ring 44 and with it its substantially axially extending collar performs a movement, shown by the double arrow 47 in FIG. 9, due to the slanted position of the ring 44 relative to the drive shaft 6 of the basket 3. Due to this movement shown by the arrow 47, the collar of the ring 44 closes the discharge gap 43 over a substantial, angular exent of the upper edge 40 of the basket 3. Merely in the location or area 41 the gap 43 is opened due to the slanted position of the rotational axis 46. At this location 41 the angular collar 45 takes up its highest elevational position. As a result, sugar can be discharged only at this location 41. To prevent the sugar from creeping into the space between the damming ring 42 and the discharge ring 44, a seal 48 is provided between the collar 45 and the outer circumferential edge of the damming ring 42.

FIG. 3 shows by arrows 49 how the sugar is discharged only within the location 41 whereby it may pass into a flow channel 50 secured to the housing 2. The length of the flow channel 50 is dimensioned so that the sugar crystals following a free flight fall down onto the floor or bottom where it may be removed without any damage to the sugar. Practically, it is possible to arrange a plurality of the centrifuges 1 in the centrifuging station so closely spaced relative to each other as is possible with conventional centrifuges, whereby, however, the flight channels 50 of a row of centrifuges will be arranged so that they do not interfere with each other in the available space.

It is desirable to adjust the angular position of the rotational axis 46 of the discharge ring 44. FIG. 2 illustrates an example how this may be accomplished. The discharge ring 44 has a bearing 51 supported on a bushing 52. The bushing 52 in turn is secured to a tilting arm 53. One end of the tilting arm 53 is journalled to a horizontal axis 54. The other end of the tilting arm 53 is connected to an adjustment device 55, for example, a threaded spindle for raising and lowering the arm 53 and with it the bushing 52, whereby the angular position of the discharge ring 44 relative to the horizontal is adjustable. It is suitable to construct the tilting device for the discharge ring 44 so that the point where the rotational axis 46 of the ring 44 crosses the rotational axis 6 of the basket 3 is stationary in space so that it does not travel up and down due to any changes in the angular position of the axis 46.

The above described continuously operating sugar centrifuge is capable of producing sugar having a high degree of purity. Similarly the centrifuge, according to the invention, is capable of producing on a continuous basis so-called liquid sugar or sugar syrup.

Figure 8:
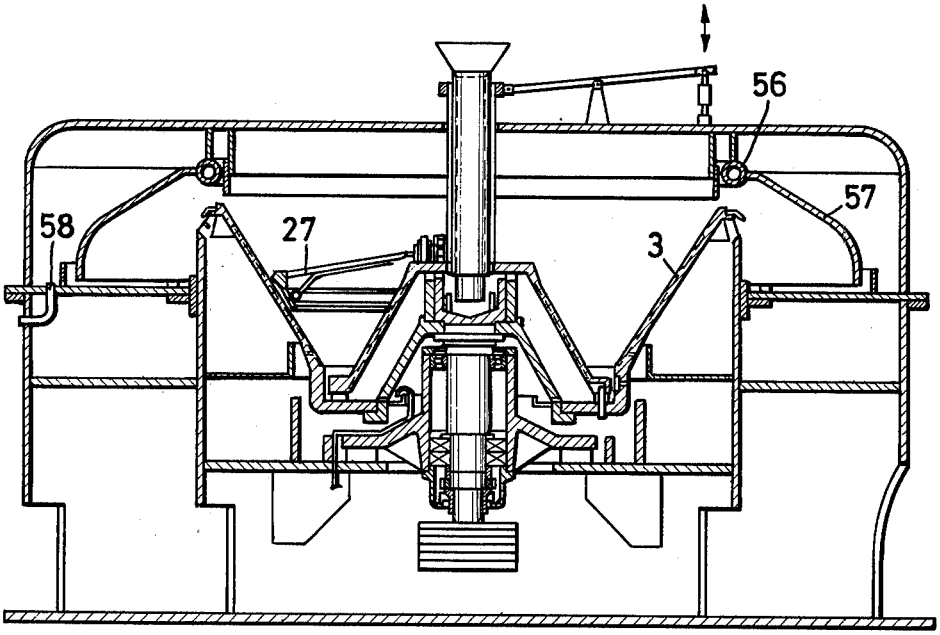
FIG. 8 illustrates the centrifuge, according to the invention, as shown in FIG. 1, in a modified form for the production of liquid sugar syrup of a high purity.

FIG. 8 illustrates a modification of the centrifuge according to the invention, suitable for the production of liquid sugar having a high degree of purity. In the production of liquid sugar it may not be necessary to provide an upper dry space 39, as shown in FIG. 1, inside the basket 3. Thus, if desired, the separation plate 27, shown in the left half of FIG. 8, may be omitted if desired as illustrated in the right hand portion of FIG. 8. However, if it is desired to provide especially high degrees of purity then it is suitable to retain the separation plate 27 and to supply further washing water or if desired, additional steam onto the sugar layer.

A centrifuge for the continuous production of sugar syrup having a high degree of purity may be provided above the upper edge 40 of the basket 3 with a nozzle ring 56 for spraying the solution liquid. Such nozzle ring 56 is provided instead of the discharge ring 44 and the damming ring 42. The nozzle ring 56 is connected to a solution enhancing ring 57 against which the discharged sugar crystals bounce together with the solution liquid. The intensive bouncing action and whirling causes a complete solution of the sugar crystals resulting in a sugar solution which may be discharged through a discharge conduit 58.

By providing a washing zone in the lower area 19 of the basket 3, the invention takes advantage of the structural features in this area by supplying washing liquid into this area through the pipe 20 as described above. Due to the cylindrical or slightly conical sidewalls of the portion 19, there is a slow-down of short duration in the flow motion of the material in the flow direction. However, the acceleration work resulting from the frictional entraining of the material causes an intensive inner flow motion of the material in the circumferential direction. The just mentioned slow-down and the frictional acceleration in the circumferential direction greatly facilitate the mixing of the material with the wash liquid supplied through the pipe 20, according to the invention to this area. This intensive mixing starts the washing of the remainder films of syrup on the crystal surface. This early start of the washing further facilitates the washing of the material when it flows over the screen of the basket 3 so that a washing required for a high purity sugar may be accomplished without the need for building up extremely thick layers of material to be centrifuged. This is an important advantage of the invention because it permits the continuous operation as opposed to the prior art batch type or thick layer operation.

The above described slanted position of the discharge ring 44 has the advantage that the sugar discharge is limited to the region 41, as shown in FIG. 3, whereby it may be directed into a flight channel 50 of substantial length in which the speed of the sugar crystals is decelerated by the friction with the air which does not damage the sugar crystals.

The above described separation plate 27 shown in FIGS. 6 and 7, makes it possible to produce a certain gauge pressure in the space below the plate 27 by the steam or water supplied under pressure. This has the advantage that the washing liquid is actually driven in the radial direction through the openings 36 in the wall of the basket 3. The realization of this effect is rather difficult in continuously operating centrifuges because the high rotational speed results in connection with conical baskets in the so-called ventilation effect which in turn causes a strong flow in the direction to the large diameter end of the basket 3. Thus, normally the washing liquid is spattered and atomized when it hits the layer of the material whereupon it is entrained in the movement toward the large end diameter of the basket or drum. This was a disadvantage because only a portion of the supplied washing water penetrates through the sugar layer and because it prevents the formation of a defined drying zone. According to the invention, the washing water, even in its atomized condition, is prevented from flowing in the direction toward the large diameter basket end, whereby it is forced to penetrate through the material layer on the basket and out through the openings 36 in the basket wall. This has the advantage that the space above the separation plate 27 is protected from any humidity and fogging and thus can be used for drying or at least preliminarily drying the sugar. Incidentally, the openings 36 facilitate the formation of an intensive pressure differential which in turn helps the washing water to penetrate through the layer of material.

The above described cylindrical or slightly outwardly flaring conical shape of the side walls of the lower portion 19 of the basket 3, according to the invention, has the advantage that the deceleration of the massecuite flow is increased whereby the washing effect is improved. The screen 23, provided at the upper end of this portion 19 assures that at all times a certain liquid motion of the wash liquid in the radial direction outwardly is possible, thereby avoiding a dry friction of the sugar crystals on the inner surface of the basket 3 under all circumstances and with certainty.

Although the invention has been described with reference to specific example embodiments, it will be appreciated, that it is intended to cover all modifications and equivalents within the scope of the appended claims.

What is claimed is:

1. A continuously operating sugar centrifuge comprising a housing, drive shaft means supported in said housing for rotation about a vertical axis, and having an upper free end, acceleration cup means rigidly secured to said free shaft end, centrifugal basket means having a bottom and an upper rim also rigidly secured to said free shaft end, acceleration cone means secured for rotation and cooperation with said basket means and with said cup means, massecuite filling pipe means centrally reaching through said housing into said cup means, said acceleration cone means comprising preliminary separation means, green flow-off discharge means arranged for cooperation with said preliminary separation means, washing means located in said centrifugal basket near said bottom thereof, damming ring means secured in said housing in spaced relationship to said upper rim of said centrifugal basket to define a discharge gap between said upper rim and said damming ring means, discharge ring means supported in said housing for rotation about an axis extending at an angle relative to said vertical axis, said discharge ring means comprising downwardly extending collar means radially outwardly of said upper rim of said centrifugal basket means whereby a sugar exit area is confined to a definite zone along said upper rim of said centrifugal basket, and flow channel means arranged to receive sugar emerging from said exit area.

2. The centrifuge according to claim 1, further comprising separation means supported inside said centrifugal basket means to define a space below the separation means, said separation means including an outer ring facing said centrifugal basket means, with a spacing between said outer ring and said basket, and washing medium supply means arranged in said space below said separation means.

3. The centrifuge according to claim 2, further comprising adjustment means arranged to cooperate with said separation means, and support means movably supporting said separation means in said centrifugal basket means, whereby said spacing between said outer ring of said separation means and said basket is adjustable.

4. The centrifuge according to claim 3, wherein said adjustment means are operatively connected to said support means whereby the separation means are movable up and down relative to said vertical axis.

5. The centrifuge according to claim 2, comprising means rigidly supporting said separation means inside said basket.

6. The centrifuge according to claim 5, wherein said means rigidly supporting said separation means secure the separation means to the centrifugal basket means whereby the latter and said separation means rotate together.

7. The centrifuge according to claim 1, further comprising support means for said discharge ring means, and adjustment means operatively connected to said support means for adjusting the angular position of said discharge ring means relative to said vertical axis of said centrifugal basket means.

8. The centrifuge according to claim 1, wherein said bottom of said centrifugal basket means forms a dish having upwardly extending side wall means and screen means covering at least part of said upwardly extending side wall means, said screen means having an open area which is small relative to the closed area of said screen means.

9. The centrifuge according to claim 8, wherein said side wall means of the dish are substantially cylindrical.

10. The centrifuge according to claim 8, wherein said side wall means of the dish are somewhat conical with a downwardly increasing diameter.

11. The centrifuge according to claim 1, wherein said centrifugal basket means comprise a conical basket proper, said conical basket having a central region above said bottom, said central region having a relatively steep conical inclination, and screen means supported on said central region, said screen means having a limited open area.

12. The centrifuge according to claim 1, wherein said acceleration cone means comprise screen means supported on the radially inwardly facing surface of said acceleration cone means, flow channel means between said screen means and said inwardly facing surface, and flow discharge means operatively connected to said flow channel means for discharging any flow-off liquid out of said centrifuge.

13. The centrifuge according to claim 12, wherein said flow discharge means comprise hollow bolts extending from said acceleration cone means through said bottom of said centrifugal basket means.

* * * * *